US008844075B2

(12) United States Patent
Heimbrock

(10) Patent No.: US 8,844,075 B2
(45) Date of Patent: Sep. 30, 2014

(54) FOOTBOARD WITH PARTIAL MATTRESS INTEGRATION

(75) Inventor: Richard H. Heimbrock, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 261 days.

(21) Appl. No.: 12/910,353

(22) Filed: Oct. 22, 2010

(65) Prior Publication Data

US 2012/0096644 A1 Apr. 26, 2012

(51) Int. Cl.

| | |
|---|---|
| ***A47B 71/00*** | (2006.01) |
| ***A61G 7/16*** | (2006.01) |
| ***A61G 7/002*** | (2006.01) |
| *A61G 7/057* | (2006.01) |
| *A61G 7/015* | (2006.01) |
| *A61G 7/053* | (2006.01) |
| *A61G 7/05* | (2006.01) |

(52) U.S. Cl.

CPC ..... *A61G 7/002* (2013.01); *A61G 7/05769* (2013.01); *A61G 7/015* (2013.01); *A61G 7/053* (2013.01); *A61G 7/16* (2013.01); *A61G 2007/0514* (2013.01)

USPC ..... 5/600; 5/722; 5/661; 5/734; 5/181; 5/618

(58) Field of Classification Search

CPC ..... A61G 7/015; A61G 7/05; A61G 7/002; A61G 7/0506; A61G 13/08; A61G 2203/30; A61G 7/05769; A61G 7/053; A61G 2007/0513; A61G 1/04; A61G 7/0755; A61G 7/1025; A61B 2562/0247; A61B 2562/168

USPC ..... 5/722, 661, 624, 734, 181, 184, 618

See application file for complete search history.

(56) References Cited

U.S. PATENT DOCUMENTS

| | | | | |
|---|---|---|---|---|
| 4,724,555 | A | 2/1988 | Poehner et al. | |
| 4,807,313 | A * | 2/1989 | Ryder et al. | 5/610 |
| 4,914,766 | A * | 4/1990 | Moore | 5/644 |
| 5,157,800 | A | 10/1992 | Borders | |
| 5,226,187 | A | 7/1993 | Borders et al. | |
| 5,279,010 | A * | 1/1994 | Ferrand et al. | 5/600 |
| 5,454,126 | A | 10/1995 | Foster et al. | |
| 5,479,666 | A | 1/1996 | Foster et al. | |
| 5,535,459 | A * | 7/1996 | DiMatteo et al. | 5/88.1 |
| 5,662,316 | A * | 9/1997 | Schaldach | 269/25 |
| 5,666,681 | A | 9/1997 | Meyer et al. | |
| 5,715,548 | A * | 2/1998 | Weismiller et al. | 5/624 |
| 5,906,016 | A * | 5/1999 | Ferrand et al. | 5/600 |
| 5,950,327 | A * | 9/1999 | Peterson et al. | 34/328 |

(Continued)

FOREIGN PATENT DOCUMENTS

WO WO 2007085828 A1 * 8/2007

*Primary Examiner* — William Kelleher
*Assistant Examiner* — Duoni Pan
(74) *Attorney, Agent, or Firm* — Barnes & Thornburg LLP

(57) ABSTRACT

A patient support apparatus is convertible between a bed position, having a generally horizontal sleeping surface upon which a person lies in a supine position, and a chair egress position, allowing a person to exit the support from a sitting position. The patient support comprises a deck, a foot panel coupled to the deck, and an inflatable bladder assembly coupled to the foot panel. The inflatable bladder assembly is coupled to the foot panel and both the foot panel and inflatable bladder assembly are removable from the deck.

20 Claims, 6 Drawing Sheets

(56) References Cited

U.S. PATENT DOCUMENTS

| | | | | |
|---|---|---|---|---|
| 5,966,763 | A | 10/1999 | Thomas et al. | |
| 6,047,424 | A * | 4/2000 | Osborne et al. | 5/713 |
| 6,049,927 | A | 4/2000 | Thomas et al. | |
| 6,073,284 | A | 6/2000 | Borders | |
| 6,119,291 | A * | 9/2000 | Osborne et al. | 5/600 |
| 6,151,739 | A | 11/2000 | Meyer et al. | |
| 6,182,316 | B1 | 2/2001 | Thomas et al. | |
| 6,185,767 | B1 * | 2/2001 | Brooke et al. | 5/600 |
| 6,202,230 | B1 | 3/2001 | Borders | |
| 6,212,714 | B1 | 4/2001 | Allen et al. | |
| 6,276,012 | B2 | 8/2001 | Borders | |
| 6,351,863 | B1 | 3/2002 | Meyer et al. | |
| 6,401,283 | B2 | 6/2002 | Thomas et al. | |
| 6,408,464 | B1 | 6/2002 | Weismiller et al. | |
| 6,427,264 | B1 * | 8/2002 | Metz et al. | 5/425 |
| 6,438,776 | B2 * | 8/2002 | Ferrand et al. | 5/600 |
| 6,446,287 | B2 | 9/2002 | Borders | |
| 6,484,334 | B1 | 11/2002 | Borders et al. | |
| 6,496,993 | B2 * | 12/2002 | Allen et al. | 5/624 |
| 6,611,979 | B2 * | 9/2003 | Welling et al. | 5/624 |
| 6,654,974 | B2 | 12/2003 | Ruehl et al. | |
| 6,684,427 | B2 | 2/2004 | Allen et al. | |
| 6,694,548 | B2 * | 2/2004 | Foster et al. | 5/600 |
| 6,694,557 | B1 * | 2/2004 | Bobey et al. | 5/714 |
| 6,754,923 | B2 | 6/2004 | Borders et al. | |
| 6,757,924 | B2 | 7/2004 | Goodwin et al. | |
| 6,832,398 | B2 | 12/2004 | Borders et al. | |
| 6,912,749 | B2 | 7/2005 | Thomas et al. | |
| 7,000,272 | B2 | 2/2006 | Allen et al. | |
| 7,073,221 | B2 | 7/2006 | Goodwin et al. | |
| 7,073,222 | B1 * | 7/2006 | Skripps | 5/618 |
| 7,216,384 | B2 | 5/2007 | Allen et al. | |
| 7,464,421 | B2 | 12/2008 | Goodwin et al. | |
| 7,520,006 | B2 | 4/2009 | Menkedick et al. | |
| 7,523,515 | B2 | 4/2009 | Allen et al. | |
| 7,669,259 | B2 | 3/2010 | Ganance et al. | |
| 7,669,263 | B2 | 3/2010 | Menkedick et al. | |
| 7,676,868 | B2 | 3/2010 | Reckelhoff | |
| 7,685,659 | B2 | 3/2010 | Heimbrock et al. | |
| 7,685,664 | B2 | 3/2010 | Stolpmann et al. | |
| 7,757,317 | B2 | 7/2010 | Ganance et al. | |
| 2002/0066142 | A1 * | 6/2002 | Osborne et al. | 5/600 |
| 2002/0170113 | A1 * | 11/2002 | Metz et al. | 5/425 |
| 2002/0170115 | A1 * | 11/2002 | Borders et al. | 5/600 |
| 2003/0086749 | A1 * | 5/2003 | Oliver et al. | 403/13 |
| 2004/0133979 | A1 * | 7/2004 | Newkirk et al. | 5/600 |
| 2006/0168729 | A1 * | 8/2006 | Weismiller et al. | 5/618 |
| 2006/0258964 | A1 * | 11/2006 | Biondo et al. | 601/152 |
| 2008/0263771 | A1 * | 10/2008 | Hakamiun et al. | 5/600 |

* cited by examiner

FOOTBOARD WITH PARTIAL MATTRESS INTEGRATION

BACKGROUND

The present disclosure relates to a patient support apparatus, such as a hospital bed, for supporting a patient. More particularly, the present disclosure relates to a foot panel integrated with an inflatable bladder assembly.

Some hospital beds known are configured to move between a conventional bed position, wherein the patient support surface is generally flat, and a chair egress position, wherein the foot end portion of the patient support surface is lowered so that a patient can egress or exit the bed from a sitting position.

The length of the foot end portion of the patient support surface that is lowered typically defines the minimum seat height of a bed in the chair egress position. It is often desirable to minimize the seat height of a bed in the chair egress position to facilitate safe patient egress from the bed. In some beds, when the foot end of the patient support surface is lowered, the foot end of the patient support surface has been retracted to minimize the bed seat height.

SUMMARY

The present application discloses one or more of the features recited in the appended claims and/or the following features which, alone or in any combination, may comprise patentable subject matter.

A patient support apparatus comprises a deck having a head end and a foot end, a foot panel removably coupled to the foot end of the deck, and an inflatable bladder assembly. The inflatable bladder assembly is coupled to the foot panel for removal therewith when the foot panel is removed from the deck.

The foot panel may include a foot panel body extending generally perpendicularly to and above a top surface of the inflatable bladder assembly. The foot panel may include a first connector engaging the deck to couple the foot panel to the deck. The first connector may include a pneumatic conduit for inflating the inflatable bladder assembly.

In some embodiments, the deck may include a first receiver, sized to receive a first connector, including a pressure sensor for measuring pressure in the inflatable bladder assembly. The first receiver may further include an attachment sensor for determining if the first receiver has received the first connector.

In some embodiments, the patient support apparatus may further comprise an air supply including an air source, a vent, and a controller. The controller may be in communication with the pressure sensor and the attachment sensor. The air supply may be pneumatically coupled to the inflatable bladder assembly to inflate the inflatable bladder assembly. The air supply may be coupled to the deck.

The deck may include a plurality of deck sections including a foot deck section. In some embodiments, the foot panel may include a foot panel deck portion removably coupled to the foot end of the foot deck section, extending generally parallel to and beyond the foot deck section. The inflatable bladder assembly may be coupled to, and may be supported by, the foot panel deck portion.

The foot panel may include a foot panel body, extending generally perpendicularly from the foot panel deck, and a first connector, spaced apart from the foot panel body and extending generally parallel to the foot panel deck portion. The first connector may be configured to pneumatically couple the inflatable bladder assembly to an air supply.

The foot panel body may be unitarily formed with the foot panel deck portion. The foot panel body may extend generally perpendicularly from the foot panel deck portion and above a top surface of the inflatable bladder assembly.

The foot deck section may be extendable. In some embodiments, the foot panel may include a first connector and the foot deck section may include a first receiver, sized to receive the first connector.

The deck may be movable between a horizontal bed position and a chair egress position and the foot panel may be removed when the deck is in the chair egress position. In some embodiments, the inflatable bladder assembly may be configured to remain inflated when the foot panel is removed from the deck.

In some embodiments, the foot panel may include a connector coupled to the foot panel for removal therewith when the foot panel is removed from the deck. The connector may include a check valve.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures, in which.

DETAILED DESCRIPTION OF THE DRAWING

Figure 1:
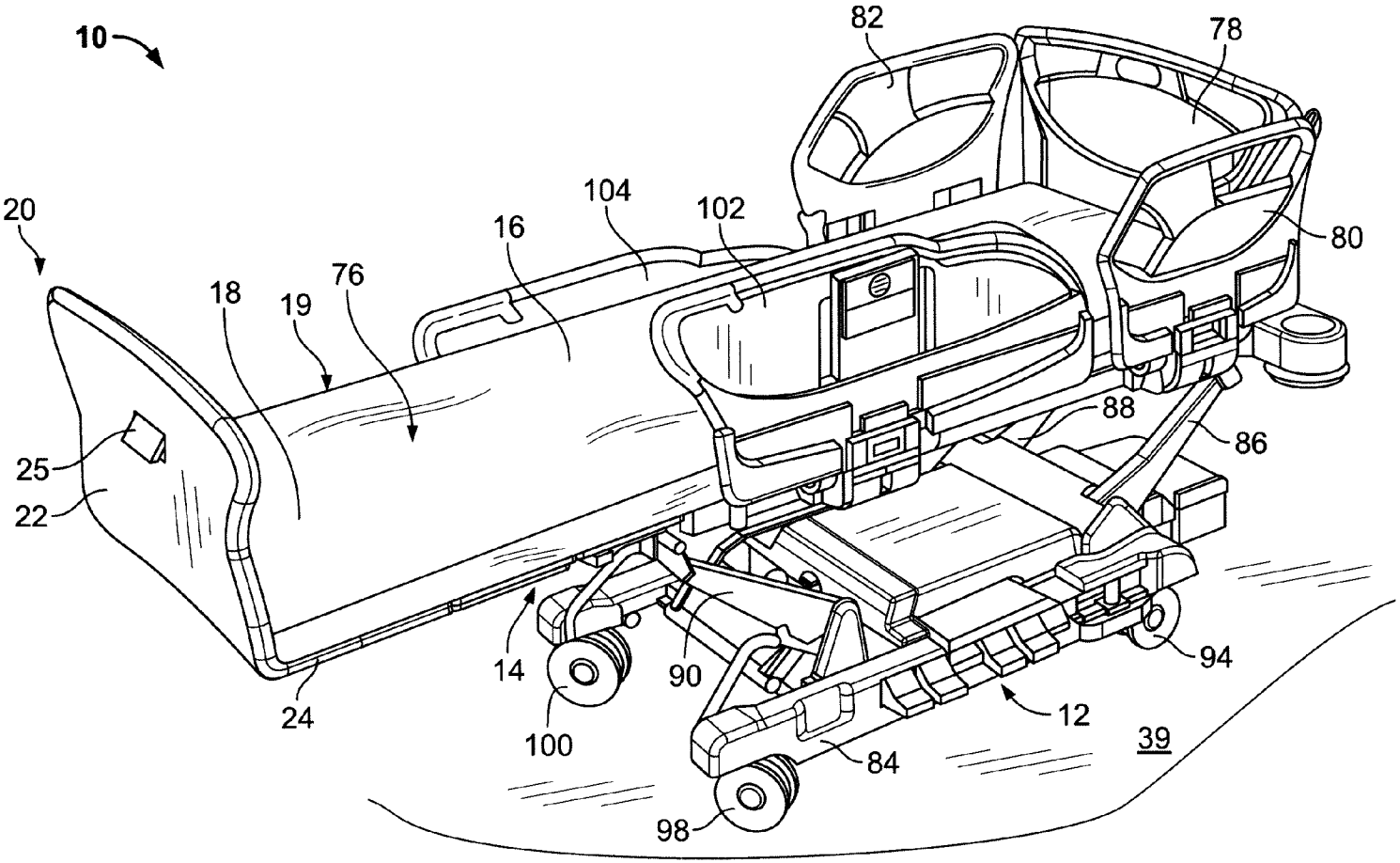
FIG. 1 is a perspective view of a patient support apparatus embodied as a hospital bed, the bed in a horizontal bed position and including a foot panel coupled to a foot-end of a deck of the hospital bed.
Figure 2:
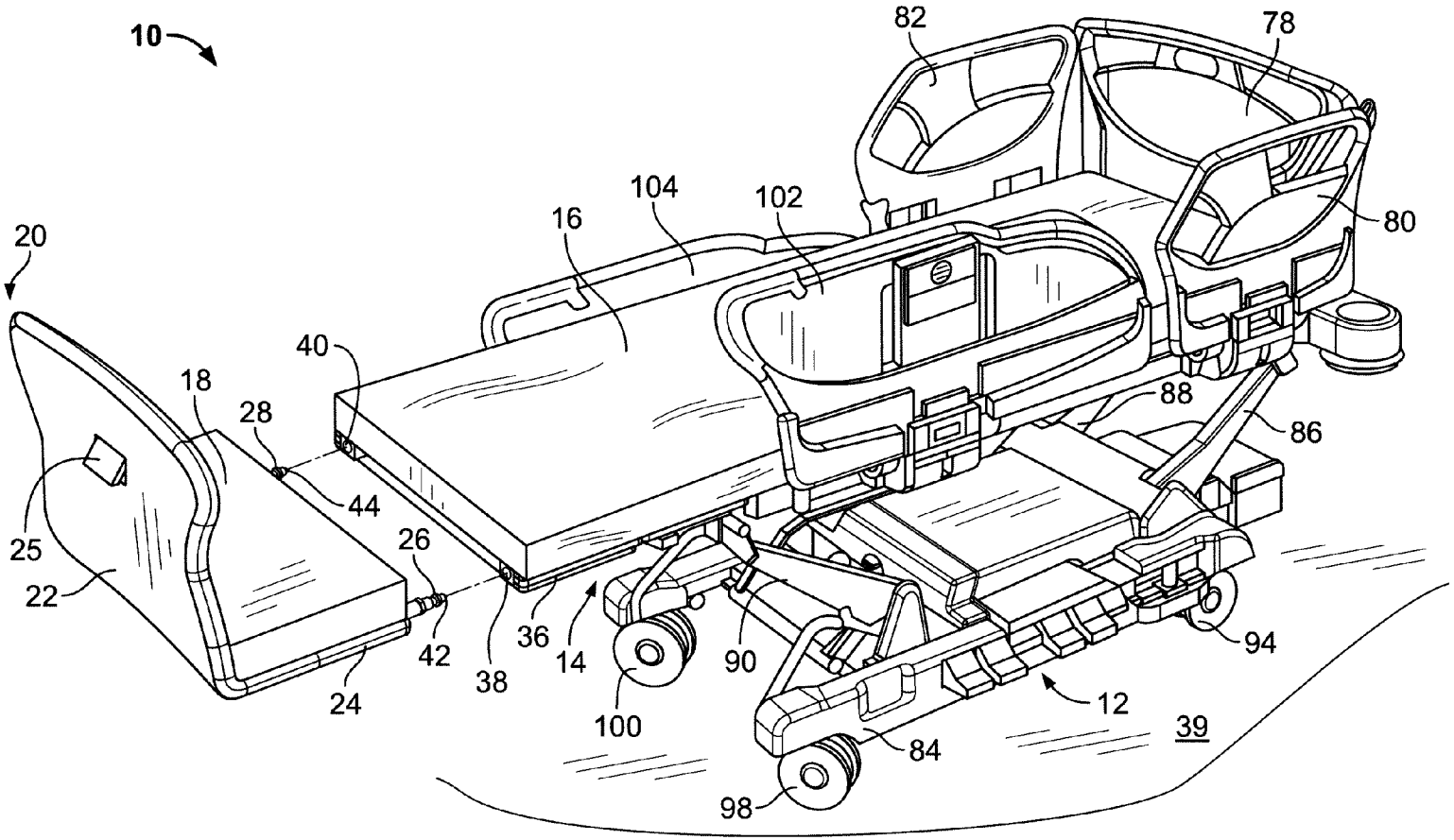
FIG. 2 is a perspective view similar to FIG. 1 with the foot panel exploded from the bed.
Figure 3:
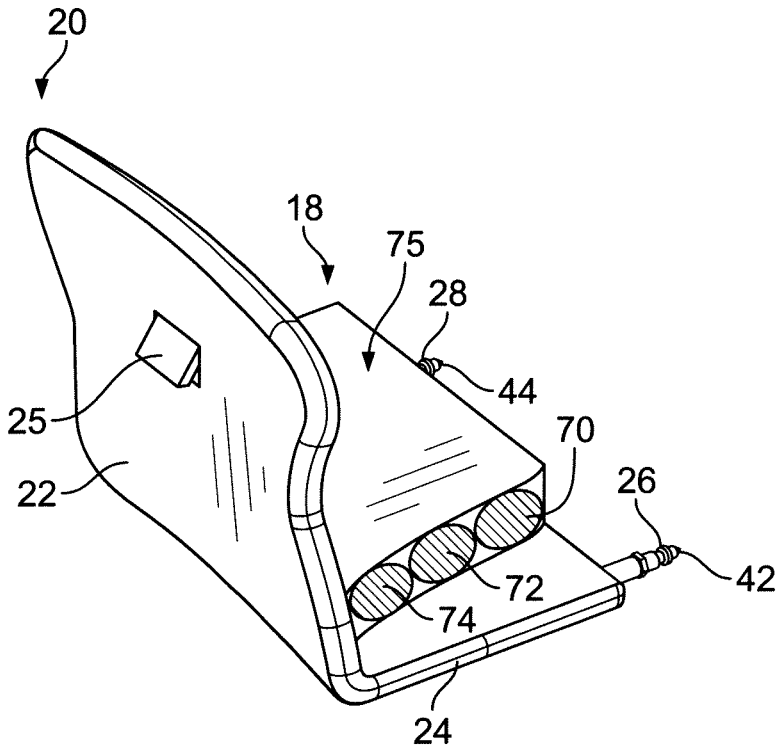
FIG. 3 is a perspective view of the foot panel of FIG. 1.
Figure 4:
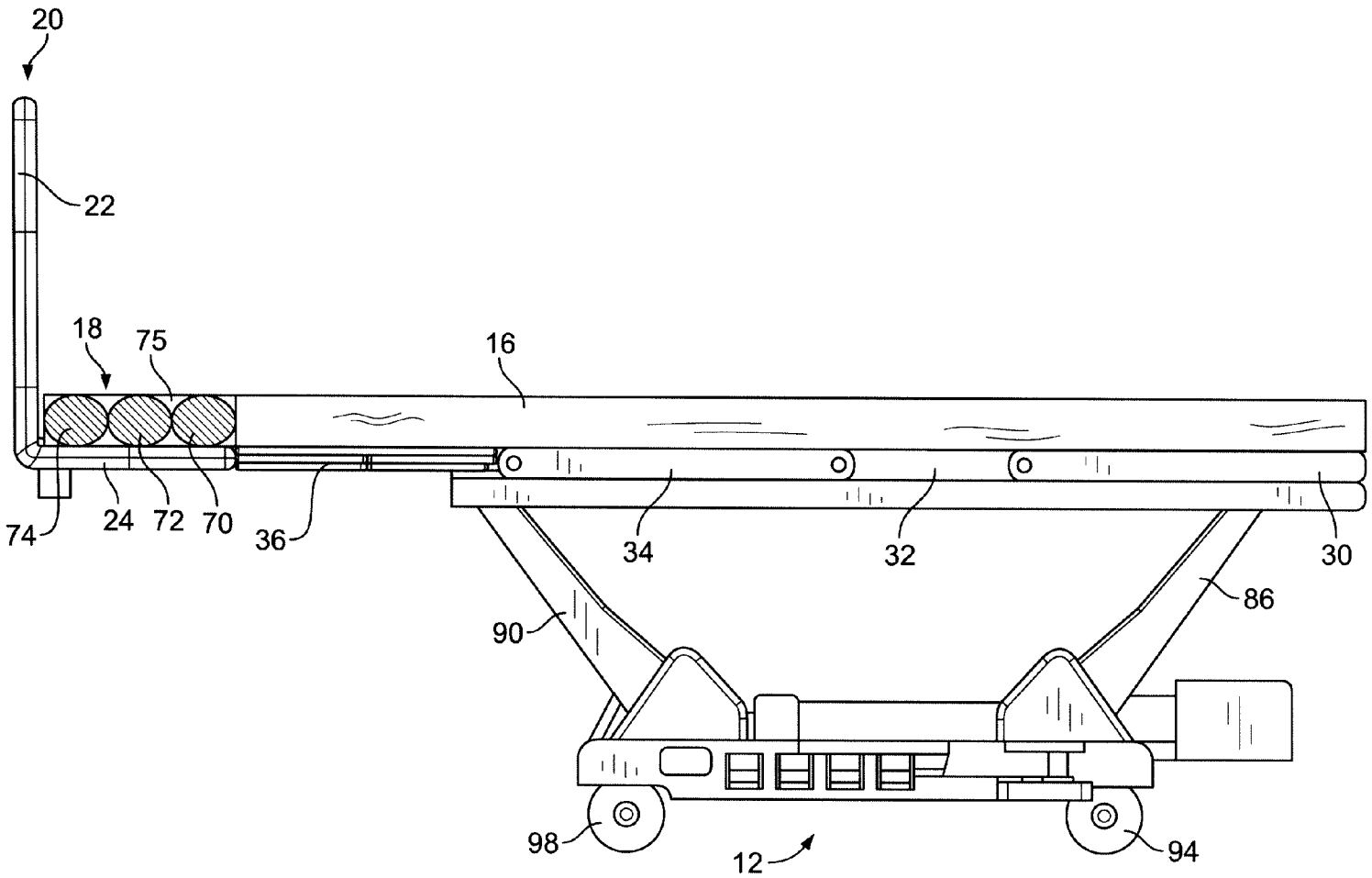
FIG. 4 is a side view of the bed of FIG. 1 in a bed position.
Figure 5:
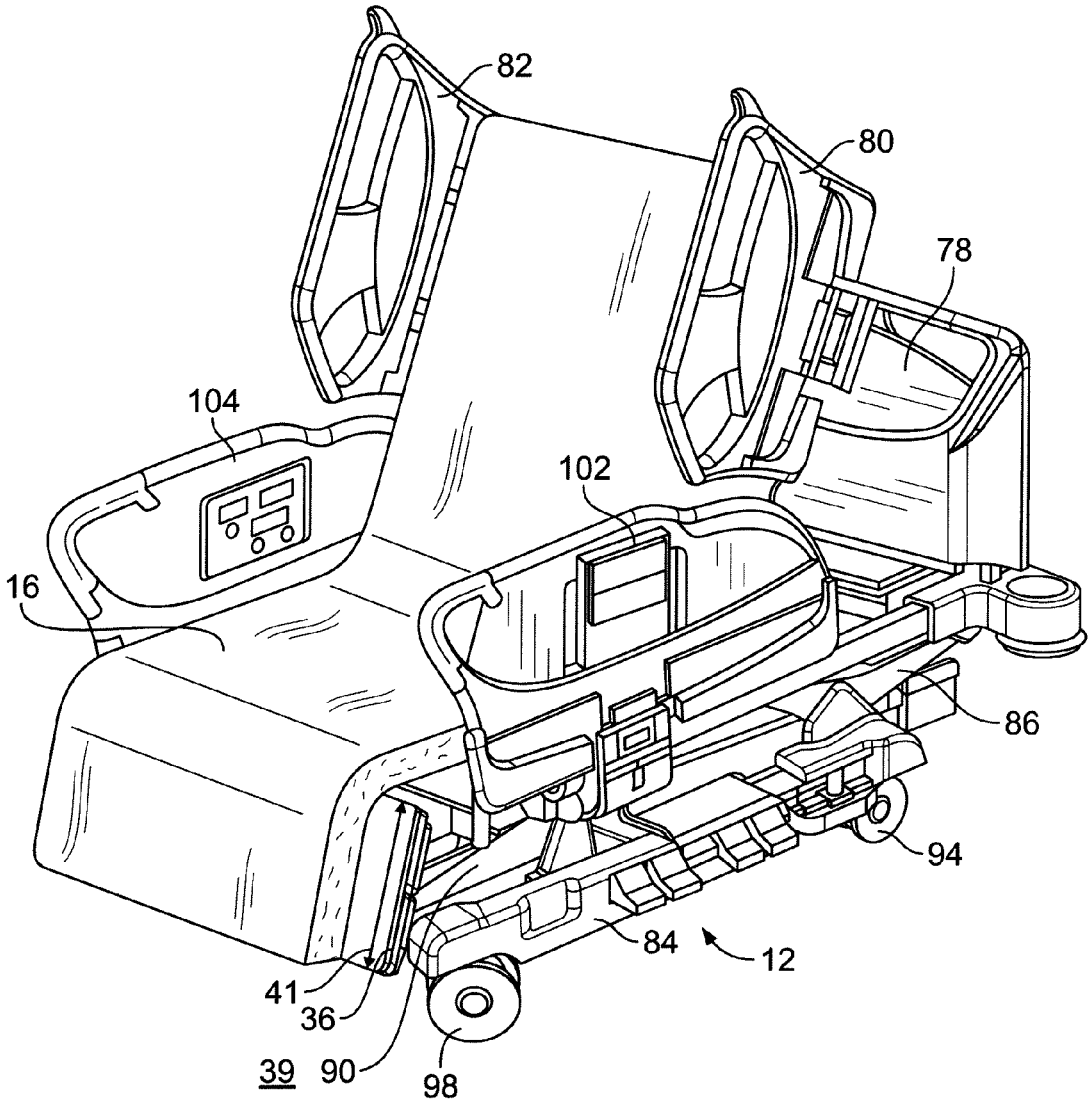
FIG. 5 is a perspective view of the bed of FIG. 1 in a chair egress position with the foot panel removed.
Figure 6:
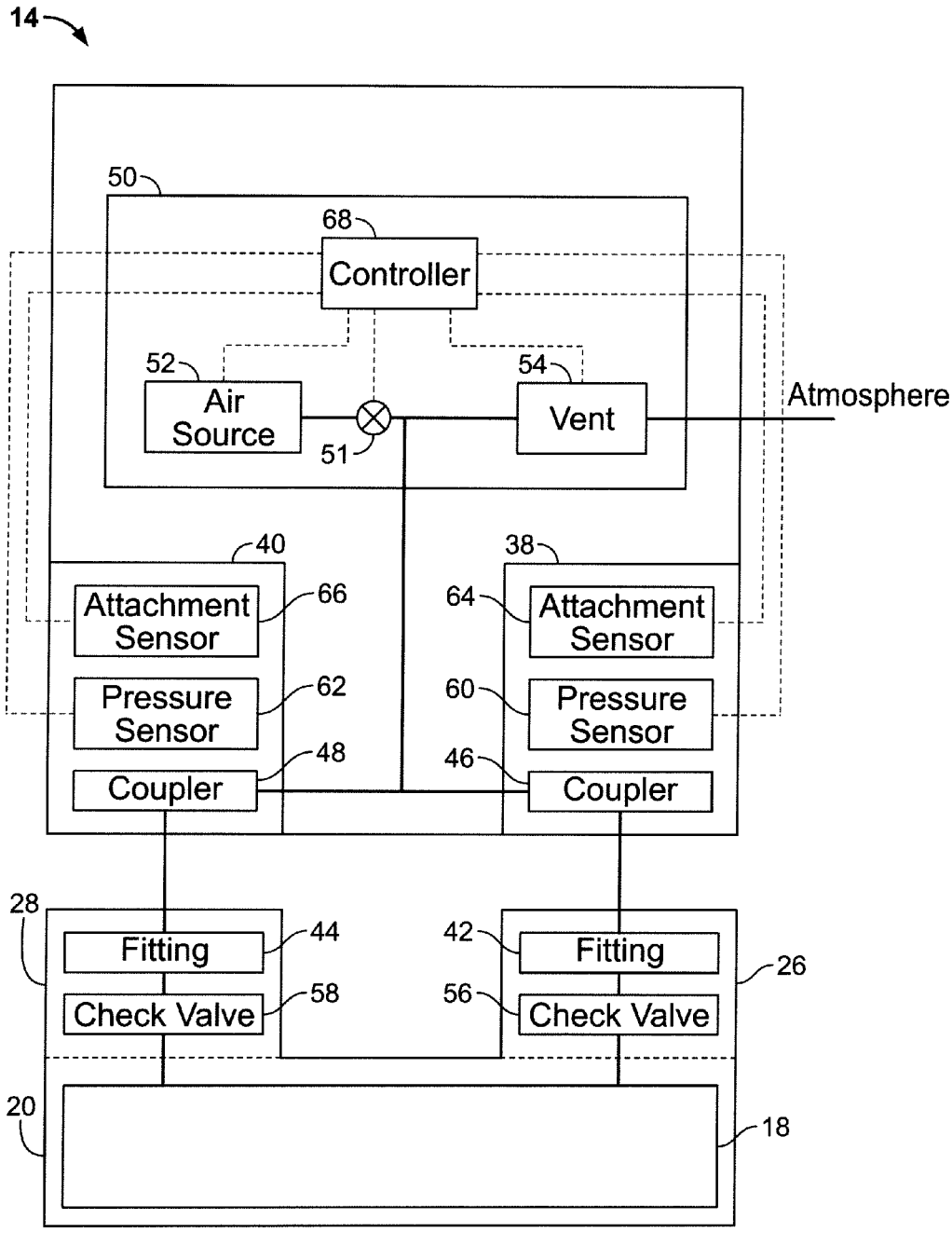
FIG. 6 is a schematic view of the hospital bed of FIG. 1.

A patient support apparatus is illustratively embodied as a hospital bed 10 having a base 12, a deck 14, and a mattress assembly 16 as shown in FIG. 1. The deck 14 is supported by the base 12. The deck 14 supports the mattress assembly 16. The bed 10 is movable between a horizontal bed position (shown in FIG. 1), wherein the deck 14 is generally flat, and a chair egress position (shown in FIG. 5), wherein the deck 14 is moved from the conventional bed position so that the patient support apparatus 10 is configured to allow a patient to egress or exit the bed 10 from a sitting position.

The bed 10 further includes an inflatable bladder assembly 18 and a foot panel 20. The foot panel 20 is removably coupled to the foot end of the deck 14. The mattress assembly 16 cooperates with the inflatable bladder assembly 18 to form a patient support area 19 when the bed 10 is in the horizontal bed position. The inflatable bladder assembly 18 is coupled to the foot panel 20 so that the inflatable bladder assembly 18 is removed along with the foot panel 20, when the foot panel is removed from the deck 14.

The foot panel 20 includes a foot panel body 22, a foot panel deck portion 24, and a first and a second connector 26, 28. The foot panel deck portion 24 extends generally perpendicularly from the foot panel body 22. The inflatable bladder assembly 18 overlies and is supported by the foot panel deck portion 24. The foot panel body 22 extends above the top surface of the inflatable bladder assembly 18. The foot panel body 22 and the foot panel deck portion 24 may be unitarily formed.

The deck 14 includes a head deck section 30, a seat deck section 32, a thigh deck section 34, and a foot deck section 36. The deck sections 30, 32, 34, 36, are configured to articulate relative to one another as the deck 14 moves from the horizontal bed position to the chair egress position. The foot deck section 36 is movable between an extended position and a retracted position. The foot deck section 36 is moved to the extended position when bed 10 is moved to the horizontal bed position. Further, the foot deck section 36 is moved to the retracted position when the bed 10 is moved to the chair egress position. The foot panel 20 removably couples to the foot deck section 36 and the top surface of the foot panel deck portion 24 is generally parallel to the top surface of the foot deck section 36. The foot panel further includes a handle 25 coupled to the foot end of the foot panel body 22.

While the bed 10 is in the chair egress position, a minimum height 41 of the seat and thigh deck sections 32, 34, is determined by the distance between the foot end of the thigh deck section 34 and the foot end of the bed 10. While the foot panel 20 is coupled to the deck 14, the foot end of the bed 10 is defined by the foot end of the foot panel 20. In this configuration, the minimum distance between the foot end of the thigh deck section 34 and the foot end of the bed 10 is the length of the foot panel 20 coupled to the foot deck section 36, in the retracted position.

When the foot panel 20 is removed from the deck 14, the foot end of the bed 10 is defined by the foot end of the foot deck section 36. In this configuration, the minimum distance between the foot end of the thigh deck section 34 and the foot end of the bed 10 is the foot deck section 36 length, in the retracted position. Thus, in some embodiments, removal of the foot panel 20 makes achievable a reduction in the minimum height 41 of the seat and thigh deck sections 32, 34, while the bed is in the chair egress position.

The foot deck section 36 includes a first and a second receiver 38, 40, sized to receive the first and the second connectors 26, 28, respectively. The first and the second connectors 26, 28, are spaced apart from the foot panel body 22 and extend from the foot deck portion 24. When the foot panel 20 is coupled to the foot deck section 36, the first and the second connectors 26, 28, are received by and coupled to the first and the second receivers 38, 40, respectively. The foot panel 20 is configured to be removed from the foot deck section 36 by a caregiver.

The first and the second connectors 26, 28, include a first and a second quick disconnect pneumatic fitting 42, 44, pneumatically coupled to the inflatable bladder assembly 18. The first and the second receivers 38, 40, include a first and a second quick disconnect pneumatic coupler 46, 48, pneumatically coupled to an air supply 50. When the foot panel 20 is coupled to the foot deck section 36, the first and the second quick disconnect pneumatic fittings 42, 44, are pneumatically coupled to the first and the second quick disconnect pneumatic couplers 46, 48. Thus, when the foot panel 20 is coupled to the foot deck section 36, the inflatable bladder assembly is pneumatically coupled to the air supply 50. In other embodiments, other suitable combinations of pneumatic connection devices are employed to couple the inflatable bladder assembly 18 to the air supply 50.

The air supply 50 includes a valve 51, an air source 52, and a vent 54. The valve 51 is movable between an open and a closed position and couples the air source 52 to the first and the second quick disconnect pneumatic couplers 46, 48, when the valve is in the open position. The air source 52 is configurable between an engaged and a disengaged state. The air source 52 provides pressurized air or other fluid when in the engaged state. In some embodiments, the air source 52 is an air compressor. In other embodiments, the air source is a fan, a compressed air canister, or some other source of pressurized fluid. The vent 54 is a valve, movable between an open and a closed position, coupling the first and the second quick disconnect pneumatic couplers 46, 48, to the atmosphere when in the open position.

The first and the second connectors 26, 28, include a first check valve 56 and a second check valve 58, configured to prevent deflation of the inflatable bladder assembly 18 when the foot panel 20 is removed from the foot deck section 36. The first and the second check valves 56, 58, are movable between an engaged and a disengaged position, allowing deflation of the inflatable bladder assembly 18. The first and the second check valves 56, 58 are disengaged when the foot panel 20 is coupled to the foot deck section 36.

The first and the second receivers 38, 40, each further include respective first and a second pressure sensors 60, 62, and respective first and a second attachment sensors 64, 66. The first and the second pressure sensors 60, 62, are configured to measure the pressure in the inflatable bladder assembly 18, when the foot panel 18 is connected to the foot deck section 36. The first and the second attachment sensors 64, 66, are configured to determine if the foot panel 20 is coupled to the foot deck section 36.

The air source 50 further includes a controller 68 in communication with and configured to control the valve 51, the air source 52, and the vent 54. The controller 68 is also in communication with the first and the second pressure sensors 60, 62, and the first and the second attachment sensors 64, 66. The controller 68 is configured to control the valve 51, the air source 52, and the vent 54. When the first and second attachment sensors 64, 66, communicate to the controller 68 that the foot panel 20 is coupled to the foot deck section 36, the controller 68 will evaluate the pressure in the inflatable bladder assembly 18 as communicated by the first and the second pressure sensors 60, 62, against a desired pressure. The controller 68 will inflate, deflate, or maintain the pressure in the inflatable bladder assembly 18 to achieve the desired pressure.

If the pressure communicated by the first and the second pressure sensors 60, 62, is lower than the desired pressure, the controller 68 will inflate the inflatable bladder assembly 18. To inflate the inflatable bladder assembly 18, the controller 68 moves the valve 51 to the open position, configures the air source 54 to the engaged state, and moves the vent 54 to the closed position.

If the pressure communicated by the first and the second pressure sensors 60, 62, is higher than the desired pressure, the controller 68 will deflate the inflatable bladder assembly 18. To deflate the inflatable bladder assembly 18, the controller 68 moves the valve 51 to the closed position, configures the air source 54 to the disengaged state, and moves the vent 54 to the open position.

If the pressure communicated by the first and the second pressure sensors 60, 62, is equal to the desired pressure, the controller 68 will maintain the inflatable bladder assembly 18 pressure. To maintain the pressure in the inflatable bladder assembly 18, the controller 68 moves the vent 51 to the closed position, configures the air source 54 to the disengaged state, and moves the vent 54 to the closed position.

The inflatable bladder assembly includes a first bladder 70, a second bladder 72, and a third bladder 74. The bladders 70, 72, 74, inflate and deflate together. The bladders 70, 72, 74, are connected by a ticking cover 75 extending over the top of the inflatable bladder assembly 18. Additionally, an extendable sheet 76 is used to cover both the mattress assembly 16 and the inflatable bladder assembly 18 when the bed 10 is in the horizontal bed position. When the bed 10 moves to the chair egress position and the foot panel 20 is removed, the extendable sheet is removed from covering the inflatable bladder assembly 18 and covers only mattress assembly 16.

The bed 10 also includes a head panel 78, a first headrail 80, and a second headrail 82. The head panel 78 extends along the head-end of the deck 14 and extends above the top surface of the mattress assembly 16, when the mattress assembly 16 is present. The head panel 78 is removable from the bed 10. The first and the second headrails 80, 82, are adjacent to the head panel 78, and extend generally perpendicular to the head panel 78, along the deck 14. The first and the second headrails 80, 82, extend above the top surface of the mattress assembly 16, when the mattress assembly 16 is present, and are adjustable across a predetermined range of heights. The head panel 78 and the headrails 80, 82, prevent patient entry to, and egress from, the bed 10 near the head-end of the bed 10.

The base 12 includes a base frame 84, a first head-end strut 86 and a second head-end strut 88, a first foot-end strut 90 and a second foot-end strut (not shown), a first head-end caster 94 and a second head-end caster (not shown), as well as a first foot-end caster 98 and a second foot-end caster 100. The first and the second head-end struts 86, 88, are coupled to the head-end of base frame 84 and to the deck 14 near the head-end of the deck 14. The first foot-end strut 90 and the second foot-end strut are coupled to the foot-end of the base frame 84 and to the deck 14 such that the foot-end of the deck 14 is cantilevered over the base 12. The first head-end caster 94 and the second head-end caster are coupled to the base frame 84 near the head-end of the base frame 84 and engage the floor 39. The first and the second foot-end casters 98, 100, are coupled to the base frame 84 near the foot-end of the base frame 84 and engage the floor 39.

The bed 10 also includes a first siderail 102 and a second siderail 104. The first and the second siderails 102, 104, extend generally perpendicularly to the foot panel body 22, along the deck 14. The first and the second siderails 102, 104, extend above the top surface of the mattress assembly 16, when the mattress assembly 16 is present, and are adjustable across a predetermined range of heights. Also, the first and the second siderails 102, 104, are removable from the bed 10.

Although certain illustrative embodiments have been described in detail above, variations and modifications exist within the scope and spirit of this disclosure as described and as defined in the following claims.

The invention claimed is:

1. A patient support apparatus comprising a deck having a head end, and a foot deck section at a foot end, and at least a first receiver positioned at the foot end of the foot deck section, the deck having a first length, a foot panel removably coupleable to the receiver to extend the length of the deck to a second length longer than the first length, the foot panel including a first connector engaging the first receiver to couple the foot panel to the foot end of the deck to support the foot panel from the deck when the foot panel is coupled to the receiver, the first connector disengageable from the first receiver to uncouple the foot panel from the foot end of the deck, and an inflatable bladder assembly positioned on the foot panel and configured to provide support for a portion of a person supported on the patient support apparatus, the inflatable bladder assembly secured to the foot panel for removal therewith when the foot panel is removed from the deck, wherein the first connector includes an integral pneumatic coupler connected to a pneumatic conduit for inflating the inflatable bladder assembly.

2. The patient support apparatus of claim 1, wherein the foot panel includes a foot panel body extending generally perpendicularly to and above a top surface of the inflatable bladder assembly.

3. The patient support apparatus of claim 1, wherein the first receiver includes a pressure sensor for measuring pressure in the inflatable bladder assembly.

4. The patient support apparatus of claim 3, wherein the first receiver further includes an attachment sensor for determining if the first receiver has received the first connector.

5. The patient support apparatus of claim 4, further comprising an air supply including an air source, a vent, and a controller, the controller in communication with the pressure sensor and the attachment sensor.

6. The patient support apparatus of claim 1, further comprising an air supply pneumatically coupled to the inflatable bladder assembly to inflate the inflatable bladder assembly.

7. The patient support apparatus of claim 6, wherein the air supply is coupled to the deck.

8. The patient support apparatus of claim 7, wherein the foot panel includes a foot panel body unitarily formed with the foot panel deck portion, extending generally perpendicularly from the foot panel deck portion and above a top surface of the inflatable bladder assembly.

9. The patient support apparatus of claim 7, wherein the foot deck section is extendable.

10. The patient support apparatus of claim 1, wherein the deck includes a plurality of deck sections including a foot deck section and the foot panel includes a foot panel deck portion removably coupled to the foot end of the foot deck section, extending generally parallel to and beyond the foot deck section.

11. The patient support apparatus of claim 10, wherein the inflatable bladder assembly is coupled to, and is supported by, the foot panel deck portion.

12. The patient support apparatus of claim 11, wherein the foot panel includes a foot panel body, extending generally perpendicularly from the foot panel deck, and a first connector, spaced apart from the foot panel body and extending generally parallel to the foot panel deck portion, configured to pneumatically couple the inflatable bladder assembly to an air supply.

13. The patient support apparatus of claim 1, wherein the deck is movable between a horizontal bed position and a chair egress position.

14. The patient support apparatus of claim 13, wherein the foot panel is removed when the deck is in the chair egress position.

15. The patient support apparatus of claim 1, wherein the inflatable bladder assembly is configured to remain inflated when the foot panel is removed from the deck.

16. The patient support apparatus of claim 15, wherein the foot panel includes a connector coupled to the foot panel for removal therewith when the foot panel is removed from the deck.

17. The patient support apparatus of claim 16, wherein the connector includes a check valve.

18. A patient support apparatus comprising a deck having a head end and a foot end, a foot panel removably coupleable to the foot end of the deck, the foot panel having an upper surface, and an inflatable bladder assembly positioned on the upper surface of the foot panel to provide support for a person supported on the patient support apparatus, the inflatable bladder assembly coupled to the foot panel for removal therewith when the foot panel is removed from the deck, wherein the foot panel includes a first connector engaging the deck to support the foot panel from the deck, and wherein the first connector includes an integral pneumatic coupler connected to a pneumatic conduit for inflating the inflatable bladder assembly.

19. The patient support apparatus of claim 18, wherein the first receiver includes a pressure sensor for measuring pressure in the inflatable bladder assembly.

20. The patient support apparatus of claim 19, wherein the first receiver further includes an attachment sensor, separate from the pressure sensor, for determining if the first receiver has received the first connector.

* * * * *